US005595086A

United States Patent [19]

Scherf

[11] Patent Number: 5,595,086

[45] Date of Patent: Jan. 21, 1997

[54] APPARATUS FOR CALIBRATING HOLLOW NONSYMMETRICAL MULTIPLANE EXTRUSIONS AND ASSOCIATED METHOD

[75] Inventor: Thomas W. Scherf, Vandergrift, Pa.

[73] Assignee: Aluminum Company of America, Pittsburgh, Pa.

[21] Appl. No.: 285,173

[22] Filed: Aug. 2, 1994

[51] Int. Cl.[6] ..... B21D 39/20

[52] U.S. Cl. ..... 72/353.4; 72/393

[58] Field of Search ..... 72/353.4, 353.6, 72/354.2, 392, 393

[56] References Cited

U.S. PATENT DOCUMENTS

| | | | |
|---|---|---|---|
| 1,039,948 | 10/1912 | Hunter . | |
| 1,823,047 | 9/1931 | Hothersall | 72/393 |
| 2,272,511 | 2/1942 | Coordes | 72/353.6 |
| 3,222,910 | 12/1965 | Roper | 72/353.4 |
| 3,581,546 | 6/1971 | Ragettli | 72/355 |
| 3,621,699 | 11/1971 | Valek et al. | 72/353.6 |
| 4,138,873 | 2/1979 | Dailey et al. | 72/316 |
| 4,380,165 | 4/1983 | Post | 72/355 |
| 4,751,839 | 6/1988 | Thomas | 72/355 |
| 4,776,196 | 10/1988 | Cudini | 72/316 |
| 4,934,170 | 6/1990 | Easterbrook et al. | 72/393 |

*Primary Examiner*—Lowell A. Larson
*Attorney, Agent, or Firm*—Arnold B. Silverman; Alan G. Towner; Thomas R. Trempus

[57] ABSTRACT

Apparatus for calibrating a nonsymmetrical hollow article includes a plurality of internal die elements which are inserted into the hollow article and are expanded by a tapered plunger so as to outwardly reform the hollow article into the desired size and shape. An external die restrains the outer surface of the portion of the hollow article during reforming. The apparatus is also usable on hollow articles which do not have a linear longitudinal axis. The surface to surface engagement between internal die members creates an interface which is preferably generally aligned with straight portions of the inner surface of the hollow article except for internal corners of the article. Corresponding methods are disclosed.

21 Claims, 5 Drawing Sheets

APPARATUS FOR CALIBRATING HOLLOW NONSYMMETRICAL MULTIPLANE EXTRUSIONS AND ASSOCIATED METHOD

BACKGROUND OF THE INVENTION

1. Field of the Invention

This invention relates to improved apparatus and methods for reforming hollow articles and, more specifically, it relates to such systems which are adapted to effect precise calibration of hollow articles which are nonsymmetrical or multiplanar, or both.

2. Description of the Prior Art

It has been known for many purposes to reform end portions of a hollow article such as, for example, a hollow metal article in order to remove imperfections or to establish a predetermined size, such as where joinder of the end to another article is desired.

It has been known, for example, to insert an expanding tool into exhaust pipes in automobiles in order to expand the same to effect efficient securement to a muffler or adjacent pipe sections.

U.S. Pat. No. 4,751,839 discloses creation of a flattened end portion on corrugated pipe in order to facilitate joinder to other corrugated pipe sections. This is accomplished by employing a series of movable internal and external dies which cooperate in reforming the pipe end. These die members are moved in and out by means of inner and outer cams.

U.S. Pat. No. 4,380,165 discloses a system for putting a flange on the end of a hollow tube by employing cooperating cammed movable internal and external die elements which are said to resist formation of undesired folds in the hollow tube.

U.S. Pat. No. 4,776,196 discloses formation of flanged workpieces by means of a wedge member which urges movable cheek members outwardly into engagement with the workpiece followed by axial movement of the cheek members.

U.S. Pat. No. 1,039,948 discloses a hydraulically operated pipe flanging machine wherein a pipe flange element is secured to a pipe through hydraulic movement of a mandrel producing responsive radial expansion of internal die members that reform the pipe.

U.S. Pat. No. 3,581,546 discloses a system for removing dents from metal cans and includes the use of an expander plug which moves internal die segments and a tapered shrinking ring to move external dies in order so that the two can cooperate.

U.S. Pat. No. 4,138,873 discloses forming rectangular conduit ends by providing a pair of outer dies which define a rectangular opening therebetween and are positioned in surrounding relationship with respect to the conduit ends. A stationary wedge is inserted into the end interior and a movable wedge is moved into it co-act therewith.

Despite these prior art teachings, there is lacking any teaching of a method of calibrating or reforming the end of a hollow object which is nonsymmetrical. There is also lacking any teaching of calibrating a hollow object which does not have a linear longitudinal axis. There remains, therefore, a real and substantial need for apparatus and methods that will achieve these objectives.

SUMMARY OF THE INVENTION

The present invention has met the hereinbefore described needs.

The apparatus of the invention is adapted to function efficiently in calibrating ends of a hollow article which are lacking in symmetry or have a nonlinear axis or both.

A plurality of expansible internal die elements for insertion into the hollow article are mounted for generally radially inward and outward movement. These die elements, when expanded, have an external contour corresponding to the desired calibrated configuration of the interior surface of the hollow article. The internal die elements define a passageway which receives a tapered plunger mounted for reciprocating movement within the passageway such that when the plunger is moved into the passageway, the die elements are urged radially outwardly into open position and when the plunger is removed, the internal die elements will move inwardly into the closed position. External die means are provided for contacting the exterior of the hollow article.

Adjacent internal die elements are preferably in surface to surface contact when in closed position and have the interface therebetween aligned with a generally flat portion of the hollow article's inner surface, except with respect to internal corners of the hollow object.

The method of the invention involves restraining the outer surface of the outside of the hollow article along the region to be calibrated, preferably by external die means. An internal die having a plurality of radially movable internal die elements, and an outer surface corresponding to the desired inner surface configuration of the hollow member is introduced into the hollow and defines a passageway. A tapered plunger is inserted into the passageway to progressively urge the internal die elements outwardly into reforming engagement with the inner surface of the hollow article. The article is progressively reformed as the plunger moves into the passageway.

It is an object of the present invention to provide apparatus and an associated method for calibrating a hollow article which is nonsymmetrical or multiplanar, or both.

It is a further object of the present invention to provide such a system which will effect precise outward reforming of at least an end portion of a hollow article so as to achieve the desired size and shape.

It is a further object of the present invention to provide such a system which is adapted for rapid automated calibrating of hollow articles.

It is yet another object of the present invention to provide such a system which may be employed on a wide variety of nonsymmetrical hollow articles.

It is yet another object of the present invention to provide such a system which will effectively reform end portions of aluminum extrusions.

These and other objects of the invention will be more fully understood from the following detailed description of the invention on reference to the illustrations appended hereto.

DESCRIPTION OF THE PREFERRED EMBODIMENTS

As employed herein, the term "nonsymmetrical hollow article" refers to a hollow article which is (a) not symmetrical about its longitudinal axis and (b) not symmetrical about any single cutting plane passing therethrough.

As employed herein, the term "multiplane" or "multiplanar" refers to hollow articles having a longitudinal axis which is nonlinear, i.e., is not straight.

As employed herein, the term "calibrating" means enlarging a portion of a hollow article to a predetermined size and shape.

Figure 1:
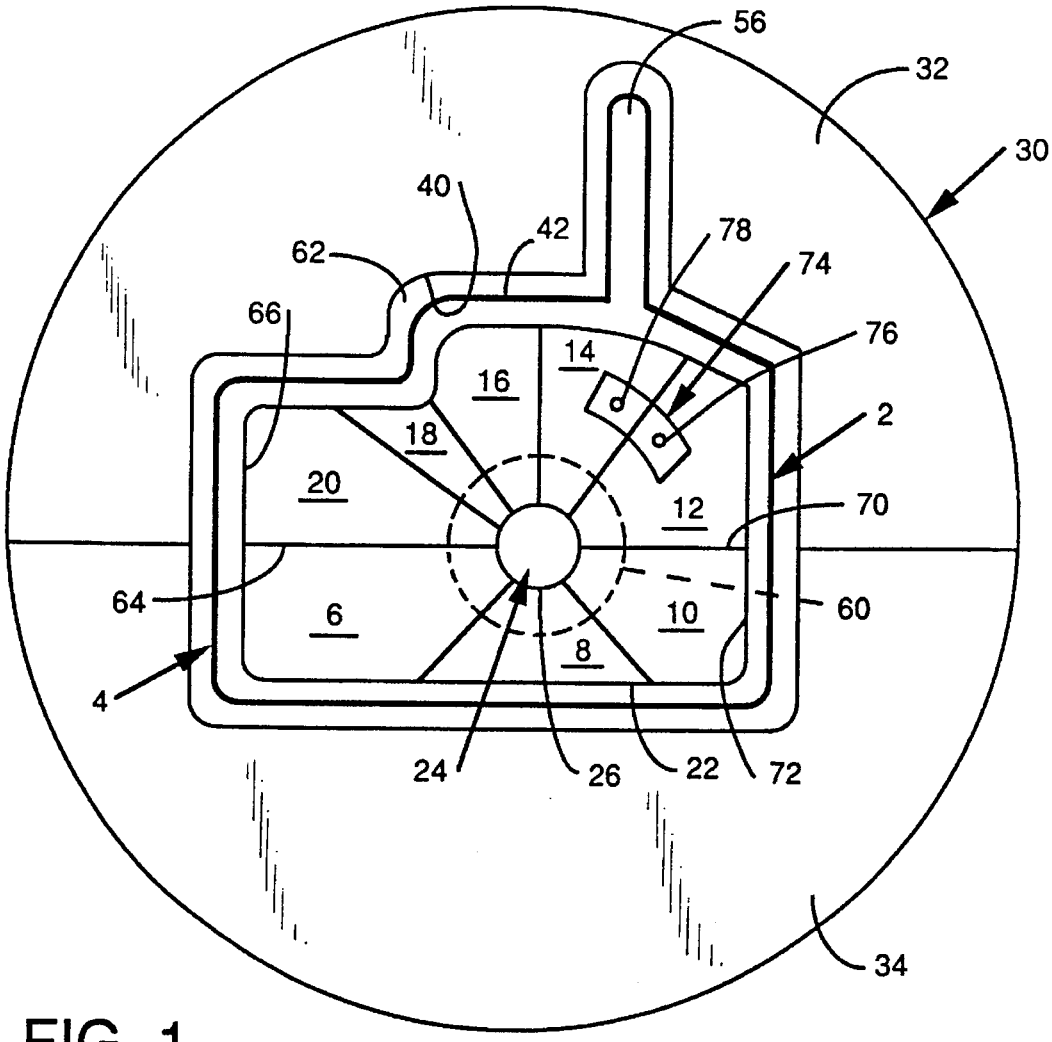
FIG. 1 is an end elevational view of a form of apparatus of the present invention and a hollow article.
Figure 2:
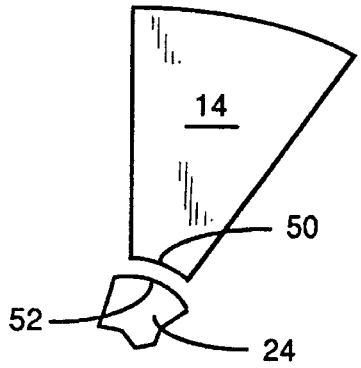
FIG. 2 is a fragmentary illustration of a portion of FIG. 1.

FIG. 1 shows an illustration of a form of the apparatus of the present invention wherein a hollow member 2, which in the form shown, is an aluminum extrusion which is nonsymmetrical. An internal die 4 contains a plurality of adjacent internal die segments 6, 8, 10, 12, 14, 16, 18, 20 which, in the aggregate, have an external surface 22 which corresponds to the shape of the internal surface of hollow member 2. The internal die 4 defines a passageway within which is positioned reciprocating tapered plunger member 24. The exterior surface 26 of the tapered plunger is in sliding engagement with inner surfaces of the element 6–20 (even numbers only) of internal die 4. The adjacent contacting surfaces are preferably substantially in surface-to-surface engagement, as is shown in FIG. 2 with respect to surface 50 of internal die element 14 and surface 52 of plunger 54. (These surfaces 50, 52, while shown as spaced from each other, for clarity of illustration are actually in surface to surface contact.) In this manner, as the tapered plunger is moved into the passageway, it will urge the die elements 6–20 (even numbers only) radially outwardly and apply sufficient force to enlarge the hollow member 2 to establish the desired size and shape. This coaction between (a) the plunger and segmented internal die element 6–20 (even numbers only) which applies the outward deforming force and (b) external die 30 which has cooperating die segments 32, 34 and has an interior surface corresponding to the desired size and shape of the external surface of hollow member 2 serves to facilitate the desired calibration. In order to effect a smooth progression of radially outwardly directed expansion of the internal die element 6–20 (even numbers only), the plunger 24 will preferably have a substantially uniform taper within the region which will be employed to effect radial movement of the die element 6–20.

Referring still to the hollow article 2 shown in FIG. 1, it will be noted that it has a solid flange portion 56 which will be translated upwardly as the internal die 4 expands radially. The dotted representation, identified by the reference number 60, shows the larger portion of the tapered plunger which will be in engagement with inner die members 6–20 when the dies have been moved radially outwardly so as to close the gap 62 between the external die 30 and the hollow article 2.

Referring still to FIG. 1, it will be noted that adjacent inner die elements 6–20, meet each other in surface to surface contact to establish interfaces, such as 64 between element 6 and 20. It is preferred that these contacting internal die surfaces be generally flat so as to facilitate efficient radial movement of the die element 6–20. It is preferred that the interfaces be aligned with a generally flat portion of the interior surface of the hollow article (except where the internal die 4 has an inside corner, in which case, it is preferred that an interface between adjacent die elements be aligned with a corner of the hollow object.) See, for example, the interface between die elements 16, 18. It will be noted that interface 64 is aligned with hollow article flat surface 66. Similarly, interface 70 between internal die elements 10, 12 is aligned with hollow article surface 72.

It will be appreciated, therefore, that even though hollow article 2 is nonsymmetrical, the apparatus of the present invention effectively provides calibration so as to produce a properly enlarged and sized article.

One of the advantageous uses of the present invention is in connection with calibration of the ends of aluminum extrusions. Hollow extrusions are of necessity formed with a longitudinal linear axis. The requirements of the end product or in environment, might necessitate subsequent transverse deformation of the same. For example, it may be necessary to bend the extrusions so as to provide a curved hollow member. This bending creates a multiplanar structure which cannot be calibrated by conventional techniques.

It is preferred that the internal die 4 have means which bias it toward a radially closed position such that when the plunger 24 is withdrawn, the internal die will assume a closed position. Shown in FIG. 1, by way of an example, is a rubber strap element 74 which is secured, respectively, to die section 12 by mechanical fasteners, such as a screw 76, and to die element 14 by mechanical fastener 78. One of these would be applied to each adjacent pair of die elements 6–20 such that after withdrawal of the piston, the internal die would be resiliently urged into a closed position.

Figure 3:
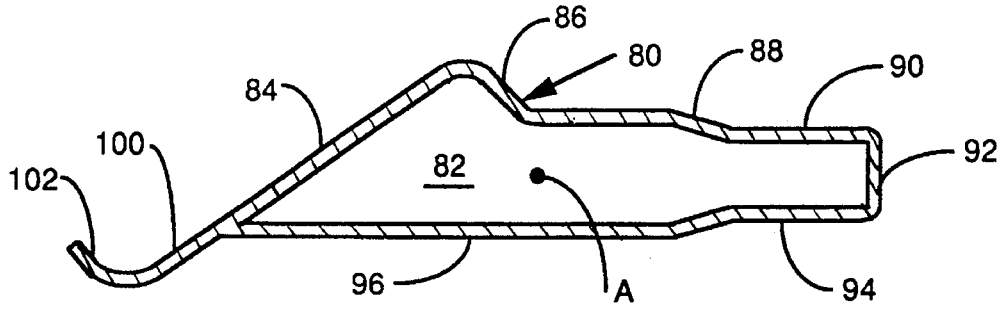
FIG. 3 is a cross-sectional view of another form of hollow article to be calibrated by the present invention taken through 3—3 of FIG. 4.
Figure 4:
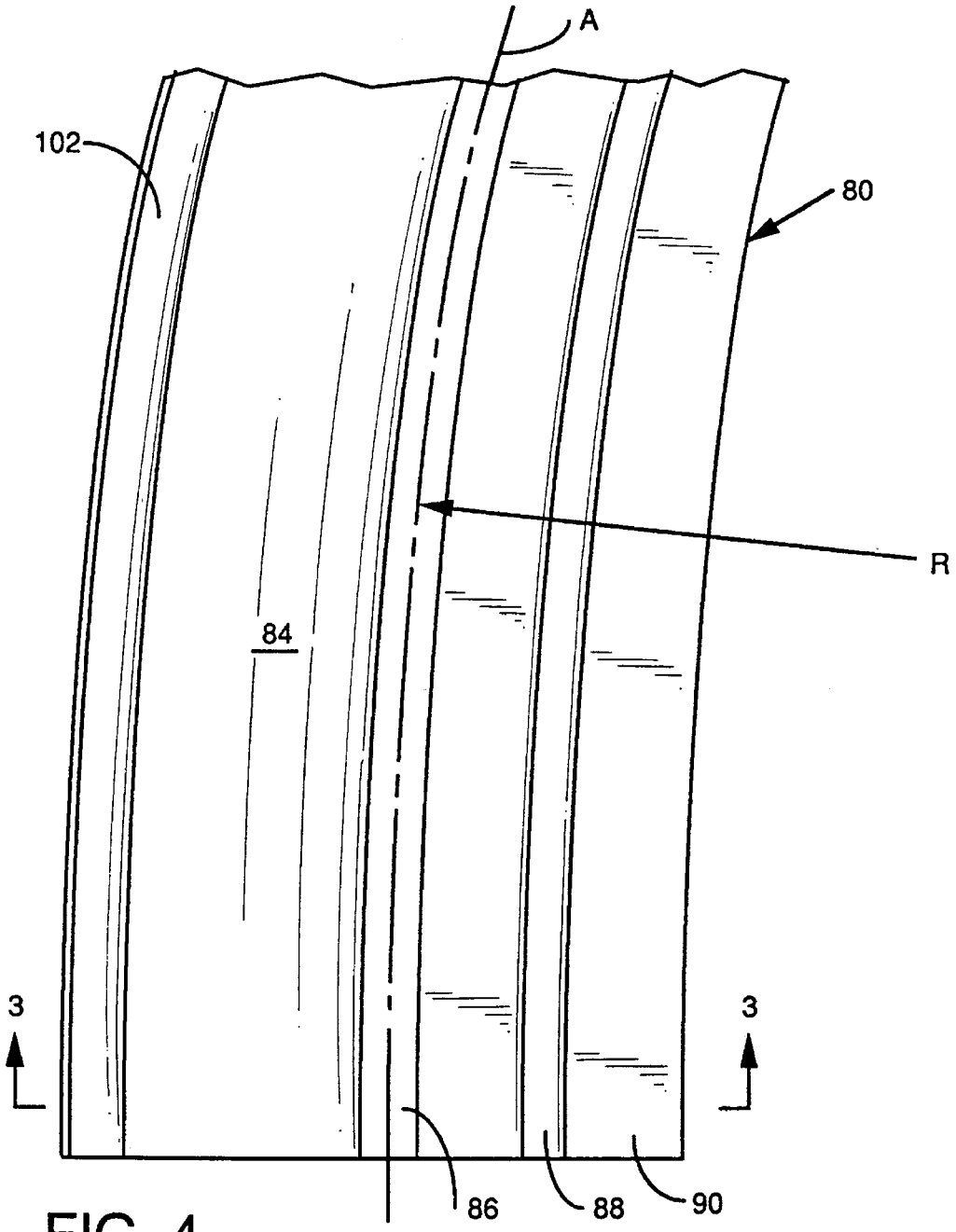
FIG. 4 is a top plan view of a portion of the hollow article of FIG. 3.

Referring to FIGS. 3 and 4, there is shown hollow article 80 which is nonsymmetrical. It has a longitudinal central axis A which is nonlinear, as shown in FIG. 4, having a uniform curvature of radius R. It will be appreciated that the invention may be employed with a wide variety of departures from a straight or linear longitudinal axis including, but not limited to simple curves, compound curves, and configurations which twist around a linear or nonlinear axis and other configurations so long as there is adequate clearance remaining for the internal die elements to be introduced into the section desired to be calibrated. The plunger will have a longitudinal axis which corresponds in shape with the longitudinal axis of the portion of the hollow article being calibrated.

In the form shown in FIGS. 3 and 4, the extrusion has a hollow region 82 which is defined by generally straight walls 84, 86, 88, 90, 92, 94, and 96. It also has a projecting fin 100 which terminates in a flange 102. The fin 100 is of solid cross-sectional configuration.

Figure 5:
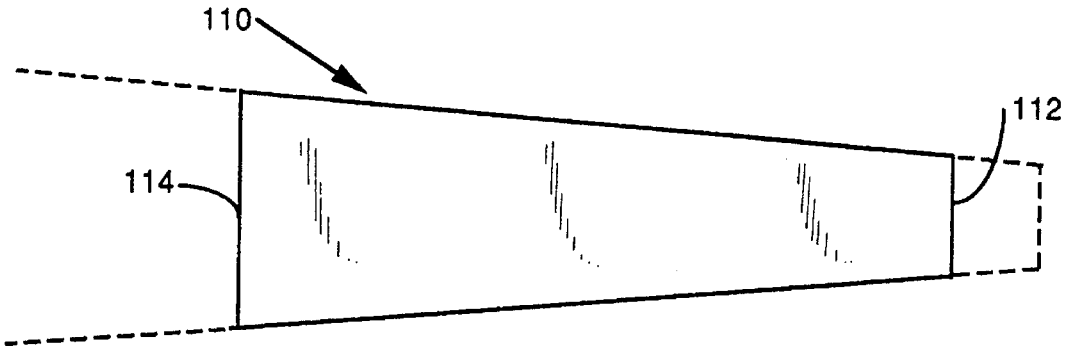
FIGS. 5 and 6 are, respectively, a front elevational view and a right-hand elevational view of a form of plunger of the present invention.
Figure 6:
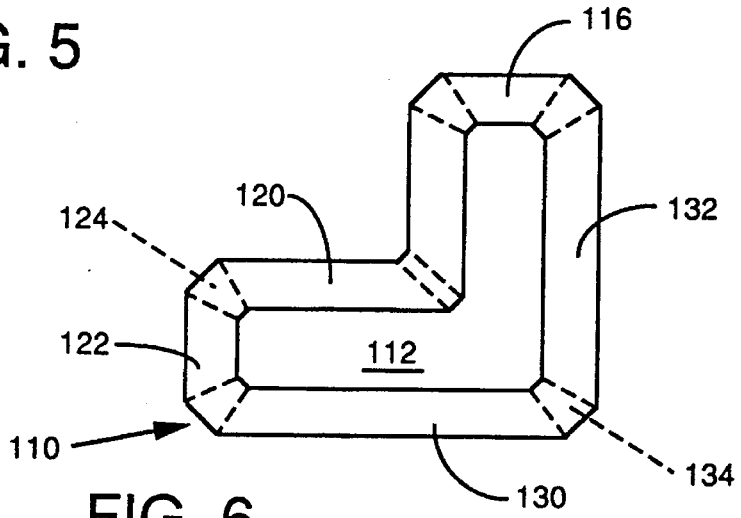
Figure 7:
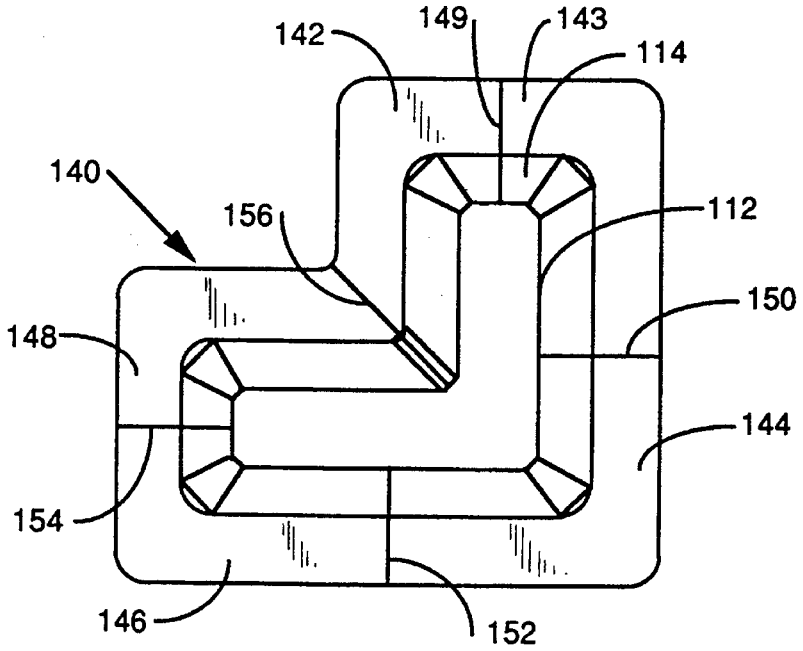
FIG. 7 is an end elevational view of the plunger of FIGS. 5 and 6 shown in combination with an associated internal die.

Referring to FIGS. 5 through 7, another embodiment of the invention will be considered. In this embodiment, an elongated generally L-shaped plunger 110 has a small end 112, a large end 114, and a tapered portion 116 therebetween. The taper is preferably substantially uniform in between end walls 112 and 114 in order to effect smooth interaction and radial movement of the internal die elements. It is noted that where adjacent lateral surfaces of the plunger meet, there are chamfers. For example, surface 120 meets surface 122 at tapered chamfered area 124. Similarly, surface 130 meets surface 132 at chamfer 134. This serves to provide the desired smooth plunger movement within the passageway defined by the internal die segments and the plunger 110.

Referring to FIG. 7, it is seen that the internal die 140 has a plurality of sections 142, 143, 144, 146, 148 which meet respectively at interfaces 149, 150, 152, 154, 156.

It will be appreciated that by inserting the assembly of FIG. 7 into a hollow generally L-shaped article and positioning the external dies therearound, inward movement of the tapered plunger 110 into the passageway would cause radial expansion of the internal die 140 to thereby outwardly reform and calibrate the hollow article.

Figure 8:
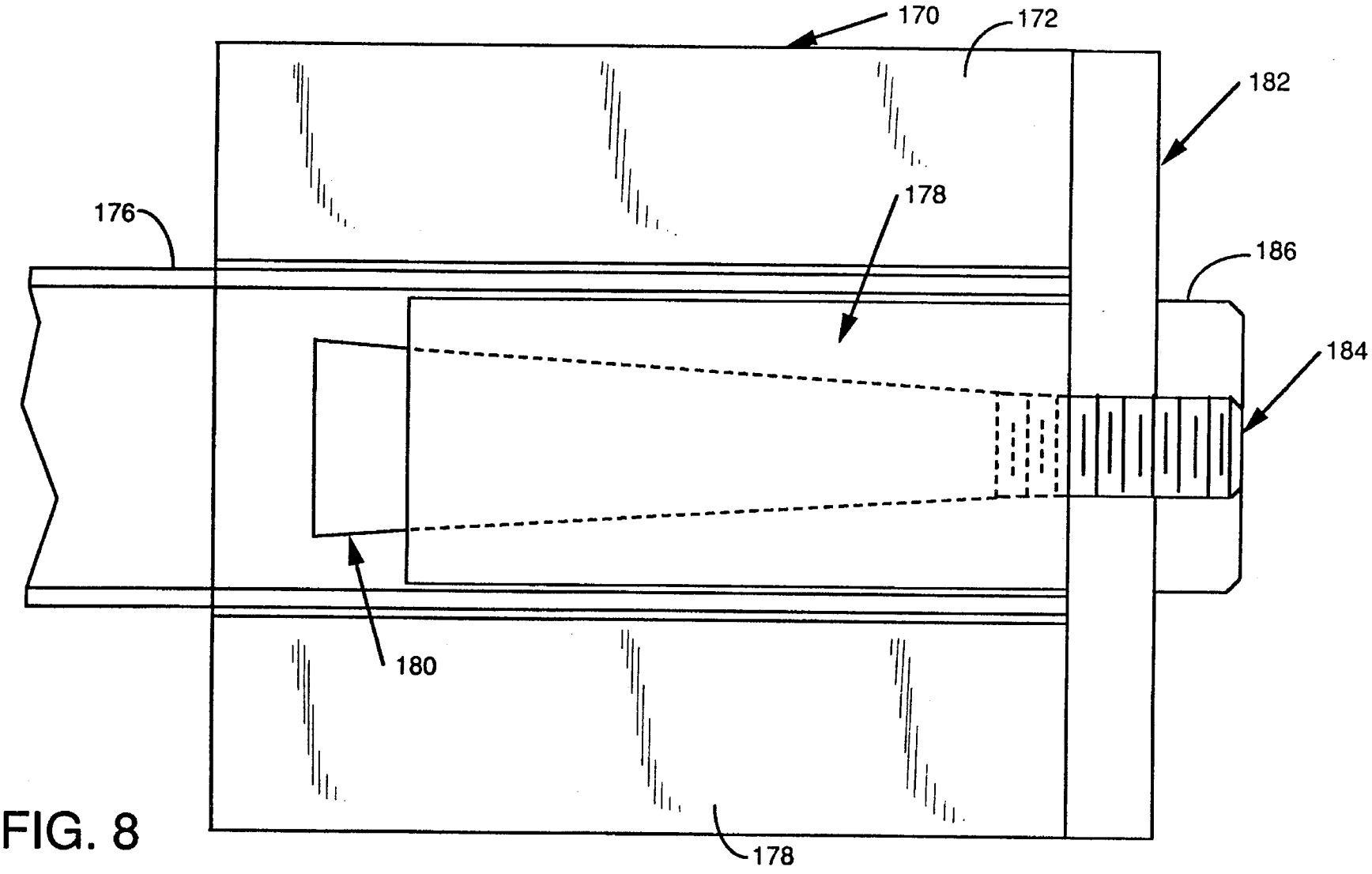
FIG. 8 is a schematic illustration of a form of apparatus of the present invention showing one embodiment of a plunger.

Referring to FIG. 8, the manner in which the plunger is reciprocated will be considered. In this embodiment, an outside die 170 has two die sections, 172, 178 which are in surrounding relationship with respect to hollow article 176 with internal die 178 disposed between tapered plunger 180 and hollow extrusion member 176. In this embodiment, a plate 182 is positioned at one end of the internal die 178 in intimate contact with outside die 170 to serve as a stop member for the hollow article 176. The plate 182 is apertured and a threaded portion 184 of tapered plunger 180 passes therethrough and is in threaded engagement with nut 186. It will be appreciated that as the nut is rotated in a first direction, the plunger 180 will be pulled to the right thereby urging the internal die segments radially outwardly to reform the hollow article 176 into the desired configuration sandwiched between the inner surface of the external die 170 and the outer surface of the internal die 178. After the desired calibration has been achieved, the direction of rotation of the nut 186 is reversed in order to cause the plunger 180 to move to the left, after which, the hollow article 176 may be removed and the next hollow article to be calibrated is inserted into the external die 170. In general, the size and taper of the plunger 180 will depend upon the particular hollow article, the axial extent which is to be reformed, and the degree of reforming required. In general, the plunger 180 will have a tapered portion which functions to move the internal dies of a length of about 0.5 to 6 inches.

Figure 9:
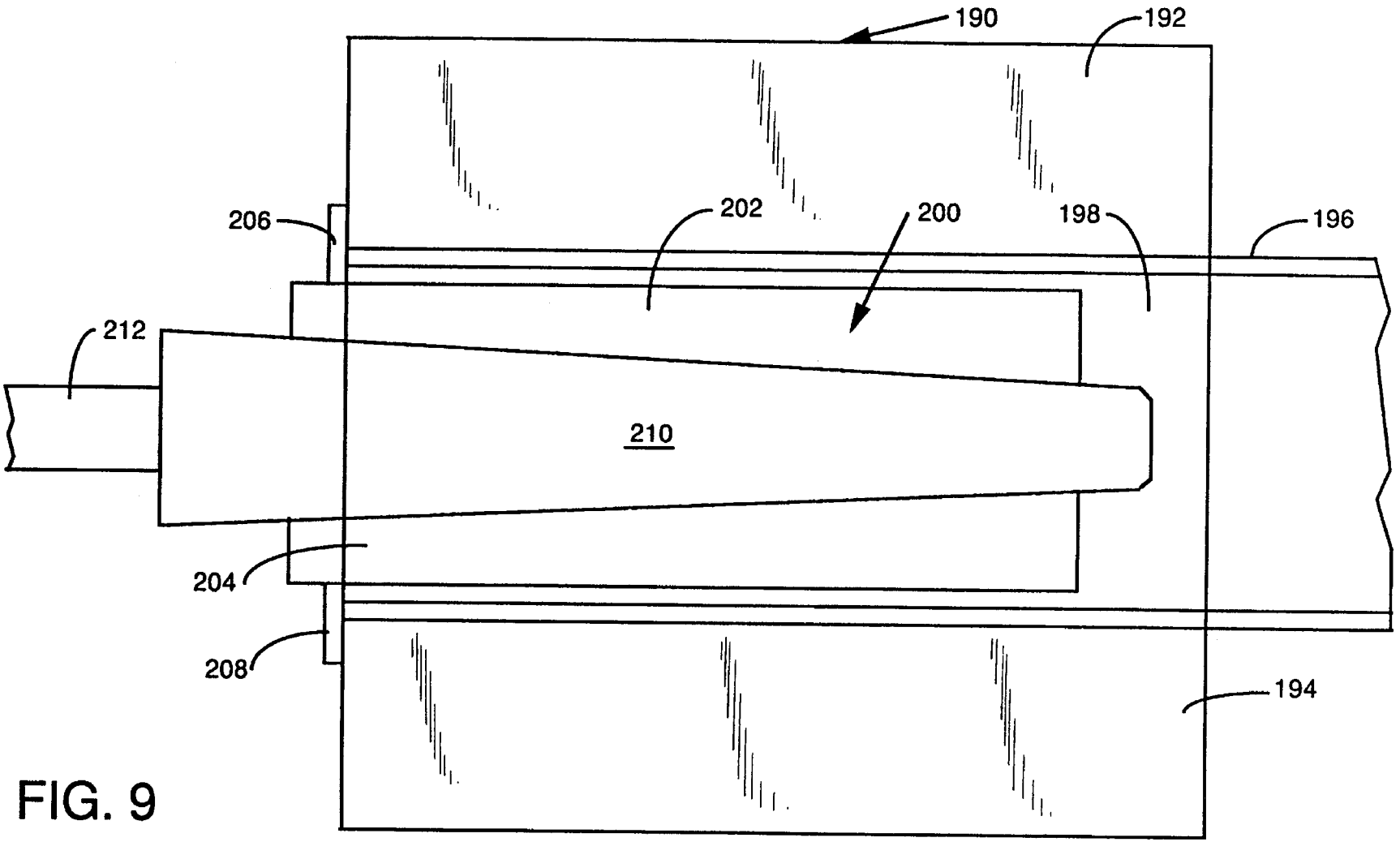
FIG. 9 is a schematic illustration showing another embodiment of the plunger of the present invention.

While FIG. 8 illustrates a plunger 180 being pulled through the internal die 178, in FIG. 9, an alternate embodiment wherein the plunger 210 is pushed inward into the external die cavity to expand the internal dies is illustrated. The external die 190 has two components 192, 194 with the hollow article 196 positioned therein. The internal die 200 has a plurality of elements, such 202, 204, each of which has an integral flange, such as 206, 208, which will serve as a stop to control the amount of entry of the internal die 200 into the die cavity of external die 190. The plunger 210 will be tapered and be secured to shaft 212, which by means of a suitable hydraulic or pneumatic cylinder (not shown), for example, may be powered to reciprocate at the proper power and speed as it enters the die cavity 198 of external die 190 to reform the hollow article 196 and will be withdrawn thereafter to permit introduction of the next hollow article.

The method of the present invention may be practiced on nonsymmetrical hollow articles, multiplanar hollow articles or articles which are both. It involves restraining the outer surface of the article along the axial region to be calibrated, inserting a segmented internal die into the article with the internal die elements defining a passageway and subsequently inserting a tapered plunger into the passageway to progressively urge the die elements radially outwardly into engagement with the inner surface of the hollow article and to reform the same as said plunger continues to move into the passageway. The plunger is subsequently withdrawn and the workpiece may then be withdrawn. The method is particularly suited to reforming the ends of hollow workpieces, such as metal extrusions, for example. The end portion being calibrated may, for example, have an axial extent of about 0.5 to 6 inches.

It will be appreciated, therefore, that the present invention has provided an effective means for reliably calibrating hollow articles which are nonsymmetrical or multiplanar, or both. All of this is accomplished with the system of the present invention in a mechanically efficient, easy to use, and reliable manner.

While for simplicity and convenience of disclosure herein, reference has been made to aluminum extrusions. It will be appreciated that the invention is not so limited. It may be employed with hollow articles made from other metals or plastics which are capable of permanent deformation under the influence of the apparatus or method of the present invention and made from techniques other than extrusion.

It will be appreciated that the invention may be employed with hollow articles having internal divider walls or ribs by employing a separate set of internal dies for each compartment of the divided hollow interior with external die support as disclosed herein.

Whereas particular embodiments of the invention have been described herein, for purposes of illustration, it will be evident to those skilled in the an that numerous variations of the details may be made without departing from the invention as set forth in the appended claims.

I claim:

1. Apparatus for calibrating a hollow article comprising a plurality of internal die elements for insertion into said hollow article mounted for generally radial inward and outward movement, said internal die elements having an external contour corresponding to the desired calibrated configuration of the interior surface of the hollow article, a passageway defined by inner portions of said internal die elements, tapered plunger means mounted for reciprocating movement within said passageway such that moving said plunger means into said passageway will urge said die elements radially outwardly into an open position and moving said plunger means outwardly with respect to said passageway will permit said die elements to move inwardly into a closed position, external die means for contacting the exterior of said hollow article, and said passageway being axially nonlinear.

2. The calibrating apparatus of claim 1 including said internal die elements being structured to calibrate a nonsymmetrical hollow article.

3. The calibrating apparatus of claim 1 including internal die elements being in general surface to surface contact when said internal die elements are in said closed position.

4. The calibrating apparatus of claim 3 including said tapered plunger means having an outer surface configuration corresponding generally to the inner surface of said internal die elements so as to provide efficient camming action to said internal die elements.

5. The calibrating apparatus of claim 4 including said tapered plunger means having internal die element engaging surfaces, and said internal die elements having generally flat plunger means engaging surfaces which are structured to be in surface-to-surface relationship with respect to said die element engaging surfaces.

6. The calibrating apparatus of claim 5 including said plunger means having chamfered outside corners.

7. The calibrating apparatus of claim 1 including said internal die elements having lateral surfaces in general surface to surface engagement with lateral surfaces of adjacent internal die elements at generally planar interfaces.

8. The calibrating apparatus of claim 7 including said generally planar interfaces except for inside corners being adapted to be aligned with flat portions of said hollow article.

9. The calibrating apparatus of claim 1 including means for urging said internal die elements radially inwardly.

10. The calibrating apparatus of claim 1 including said plunger means being a unitary plunger having a generally uniform taper within the region which engages said internal die elements.

11. The calibrating apparatus of claim 10 including power means for reciprocating said plunger within said passageway.

12. The calibrating apparatus of claim 10 including said plunger means having longitudinal axis of a shape corresponding generally to the longitudinal axis of said hollow article.

13. The calibrating apparatus of claim 12 including said plunger having a length in the portion contacting said internal die elements of about 0.5 to 6 inches.

14. The calibrating apparatus of claim 10 including stop means for limiting movement of said internal die means into said external die means.

15. A method of calibrating a nonsymmetrical hollow article comprising restraining the outer surface of said article along the region to calibrated, inserting into said hollow article an internal die having a plurality of radially expansive elements which define an axially nonlinear passageway, inserting a tapered plunger into said passageway to progressively urge said internal die elements outwardly into engagement with said inner surface of said hollow article, said progressively reforming of said hollow article outwardly into the desired calibrated nonsymmetrical size and shape by continued movement of said plunger within said passageway, and subsequently withdrawing said plunger from said passageway.

16. The calibrating method of claim 15 including employing said process on a hollow metal article.

17. The calibrating method of claim 16 including positioning said internal die elements in adjacent lateral surface to surface contact when said internal die elements are in radially retracted position.

18. The calibrating method of claim 17 including positioning the interface between contacting said internal die element surfaces in alignment with flat portions of the inner surface of said hollow article except at internal corners of said hollow article.

19. The calibrating method of claim 16 including employing said method on an aluminum extrusion.

20. The calibrating method of claim 15 including employing said process on an end portion of said hollow article which about 0.5 to 6 inches in length.

21. The calibrating method of claim 15 including effecting said restraint on said outer surface by external die means.

* * * * *